US011318757B2

(12) United States Patent
Leo et al.

(10) Patent No.: US 11,318,757 B2
(45) Date of Patent: May 3, 2022

(54) METHOD AND APPARATUS FOR DIGITAL DYEING OF THREAD

(71) Applicant: Xerox Corporation, Norwalk, CT (US)

(72) Inventors: Michael Leo, Penfield, NY (US); Brendan C. Casey, Webster, NY (US); Wayne A. Buchar, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 383 days.

(21) Appl. No.: 16/506,162

(22) Filed: Jul. 9, 2019

(65) Prior Publication Data

US 2021/0008868 A1 Jan. 14, 2021

(51) Int. Cl.

| | |
|---|---|
| ***B41F 17/10*** | (2006.01) |
| ***D06B 11/00*** | (2006.01) |
| ***B41J 3/407*** | (2006.01) |
| ***B41F 17/00*** | (2006.01) |
| ***B41J 11/00*** | (2006.01) |

(52) U.S. Cl.

CPC ..... *B41J 3/4078* (2013.01); *B41F 17/003* (2013.01); *B41F 17/10* (2013.01); *B41J 11/0024* (2021.01); *B41J 11/00214* (2021.01); *D06B 11/002* (2013.01)

(58) Field of Classification Search

None

See application file for complete search history.

(56) References Cited

U.S. PATENT DOCUMENTS

| | | | | |
|---|---|---|---|---|
| 1,384,940 | A | 7/1921 | Denison | |
| 2,644,423 | A | 7/1953 | Bauer | |
| 3,227,077 | A | 1/1966 | Farrer et al. | |
| 3,600,730 | A | 8/1971 | Evans | |
| 3,762,867 | A | 10/1973 | Crawford | |
| 4,308,716 | A | 1/1982 | Bauer | |
| 4,465,005 | A * | 8/1984 | Eguchi | D05B 67/00 112/136 |
| 5,226,973 | A | 7/1993 | Chapman et al. | |

(Continued)

FOREIGN PATENT DOCUMENTS

| | | | |
|---|---|---|---|
| GB | 2166766 | A | 5/1986 |
| JP | 2014224899 | A * | 12/2014 |

(Continued)

OTHER PUBLICATIONS

Lee T. et al., "Nozzle-Free Liquid Microjetting via Homogeneous Bubble Nucleation", Physical Review Applied 3, 044007 (2015).

(Continued)

*Primary Examiner* — Leslie J Evanisko

(74) *Attorney, Agent, or Firm* — Fox Rothschild LLP

(57) ABSTRACT

A thread printing system includes a source spool containing thread. The system also includes various print heads, each of which is fluidly connected to an ink tank. The print heads are positioned to direct and apply ink to a segment of the thread as the thread travels along a transport path along from the source spool. The system also includes a fuser having one or more print rollers that are connected to a heating element. The fuser receives the dyed thread and fuses the ink to the thread. The system may include a controller that is configured to apply ink of different colors to different segments of the thread.

20 Claims, 5 Drawing Sheets

(56) References Cited

U.S. PATENT DOCUMENTS

| | | | | |
|---|---|---|---|---|
| 5,853,859 | A | 12/1998 | Levy et al. | |
| 6,189,989 | B1 | 2/2001 | Hirabayashi et al. | |
| 6,276,779 | B1 | 8/2001 | Smith | |
| 6,690,908 | B1 | 2/2004 | Gayoso | |
| 7,302,308 | B2 | 11/2007 | Kato et al. | |
| 7,378,130 | B2 | 5/2008 | Coronado et al. | |
| 8,993,061 | B2 | 3/2015 | Jones et al. | |
| 9,162,503 | B2 | 10/2015 | Monteiro et al. | |
| 10,525,734 | B1 * | 1/2020 | Jackson | B41M 3/144 |
| 2005/0195261 | A1 | 9/2005 | Stelter et al. | |
| 2007/0095218 | A1 | 5/2007 | Strange | |
| 2011/0254896 | A1 | 10/2011 | Ferrarotti et al. | |
| 2013/0194338 | A1 | 8/2013 | Hawkins et al. | |
| 2018/0171520 | A1 | 6/2018 | Eklind et al. | |

FOREIGN PATENT DOCUMENTS

| | | | | |
|---|---|---|---|---|
| WO | 2010076823 | A1 | 7/2010 | |
| WO | WO-2016204686 | A1 * | 12/2016 | D05C 11/24 |
| WO | 2017200473 | A1 | 11/2017 | |
| WO | 20170203524 | A1 | 11/2017 | |

OTHER PUBLICATIONS

Jang D. et al., "Influence of Fluid Physical Properties on Ink-Jet Printability", Langmuir 2009, 25, pp. 2629-2635.

He B. et al., "The roles of wettability and surface tension in droplet formation during inkjet printing", Scientific Reports 7 (1), Feb. 2017.

Friend J. et al., "Microscale acoustofluidics: Microfluidics driven via acoustics and ultrasonics", Reviews of Modern Physics, vol. 83, Apr.-Jun. 2011.

Hadimioglu B. et al., "Acoustic Ink Printing", Ultrasonics Symposium, 1992, Proceedings, IEEE.

Ellson R. et al., "Transfer of Low Nanoliter Volumes between Microplates Using Focused Acoustics—Automation Considerations", JALA, Oct. 2003.

Roessler C.G. et al., "Acoustic Injectors for Drop-On-Demand Serial Femtosecond Crystallography", Structure 24, 631-640, Apr. 5, 2016.

* cited by examiner

METHOD AND APPARATUS FOR DIGITAL DYEING OF THREAD

BACKGROUND

Printers have long been used for a variety of applications, with the most typical application being applying ink or toner onto a two-dimensional substrate such as paper. Recent advancements in printing technology (and inkjet printing technology, in particular) have made printing on three-dimensional surfaces possible, including printing on cylindrical objects. However, when the objects are fabric, printing directly on the object can result in undesirable effects. As the object stretches and individual fibers move, areas in which the ink did not touch individual fibers may appear. In addition, it can be difficult to obtain multi-color effects when printing directly on fabric, since the color boundaries can move as the fabric stretches.

To address this, mechanisms have been developed that enable the printing of ink onto individual strands of thread. However, such machines are often limited to producing threads of a single color, and in many cases they require specially designed print heads and/or expensive curing systems (such as systems that use ultraviolet light).

Accordingly, there is a need for improved methods and systems for printing on thread that address the issues described above. This document describes methods and systems that address these and/or additional issues.

SUMMARY

In various embodiments, a thread printing system includes a source spool for holding a thread, as well as a set of print heads, each of which is fluidly connected to an ink tank for holding ink. The print heads are positioned to direct and apply ink to a segment of the thread as the thread travels along a transport path along from the source spool. The system also includes a fuser comprising at least a first roller that is connected to a heating element. The fuser is positioned to receive the thread after the print heads apply ink to the thread so that the heat will fuse the ink to the thread. The fuser also may include a second roller that is positioned to contact the first roller at a contact point. The fuser is positioned to pass the thread through the contact point. The system also may include a drive motor that is configured to cause the first roller, the second roller, or both to rotate.

In various embodiments, the thread printing system includes a controller, a print engine, and a memory containing programming instructions that are configured to cause the controller to implement a thread printing process. In this process, the system will receive a pattern comprising a first segment length and a first color, and command the print engine to cause the print heads to apply ink of the first color to a first segment of the thread as the thread travels along the transport path past the print heads. The first segment of the thread will have a length that corresponds to the first segment length. The system will stop the print heads from applying the ink of the first color to the thread when the first segment length has passed the print heads In some embodiments, the controller also may use the pattern to identify a second segment length and a second color. The controller also may command the print engine to cause the print heads to apply ink of the second color to a second segment of the thread as the thread travels along the transport path past the print heads. The second segment of the thread will be adjacent to the first segment of the thread and have a length that corresponds to the second segment length. The system will stop the print heads from applying the ink of second color to the thread when the second segment length has passed the print heads.

Optionally, the system may include a guide structure that is positioned and configured to receive the thread from the spool at any of various angles. The guide structure may and direct the thread from the spool to the transport path. The system also may include a take-up spool that is positioned and configured to receive the thread from the fuser and wrap the thread around a bobbin.

In some embodiments, the fuser may include a first frame element that is attached to the first print roller, a second frame element that is attached to the second print roller, and a spring that is connected to the first frame element and the second frame element to draw the frame elements and rollers toward each other. The fuser may thus (or otherwise) be configured to pull the thread along the transport path past the print heads.

In some embodiments, the system may use an ultraviolet (UV) ink. If so, the system may include a UV light source positioned between the print heads and the fuser and operable to direct UV light toward the thread before the thread enters the fuser.

In some embodiments, a shield may be positioned over at least a portion of the fuser. The fuser will be operable to retain gas emitted by the ink in the area of the fuser during operation.

In some embodiments, a thread printing system that includes a source spool, plurality of print heads, a controller, and a fuser comprising at least one roller that is connected to a heating element will receive a pattern comprising a first segment length and a first color. The system will pass thread from the source spool along a transport path that corresponds to ink ejection locations of the print heads. The print heads will apply one or more colors of ink to a one or more segments of the thread as the thread travels along the transport path past the print heads. The system will then transport the thread with applied ink to the fuser. The fuser will apply heat to the thread to fuse the applied ink to the thread. The rollers of the fuser may pull the thread along the transport path, such as by applying force to the thread at the contact point as the thread passes through the contact point. The system also may include a take-up spool; and if so the take-up spool will receive the thread from the fuser and wrap the thread around a bobbin.

DETAILED DESCRIPTION

Various terms that are used in this disclosure are defined at the end of this Detailed Description.

Figure 1:
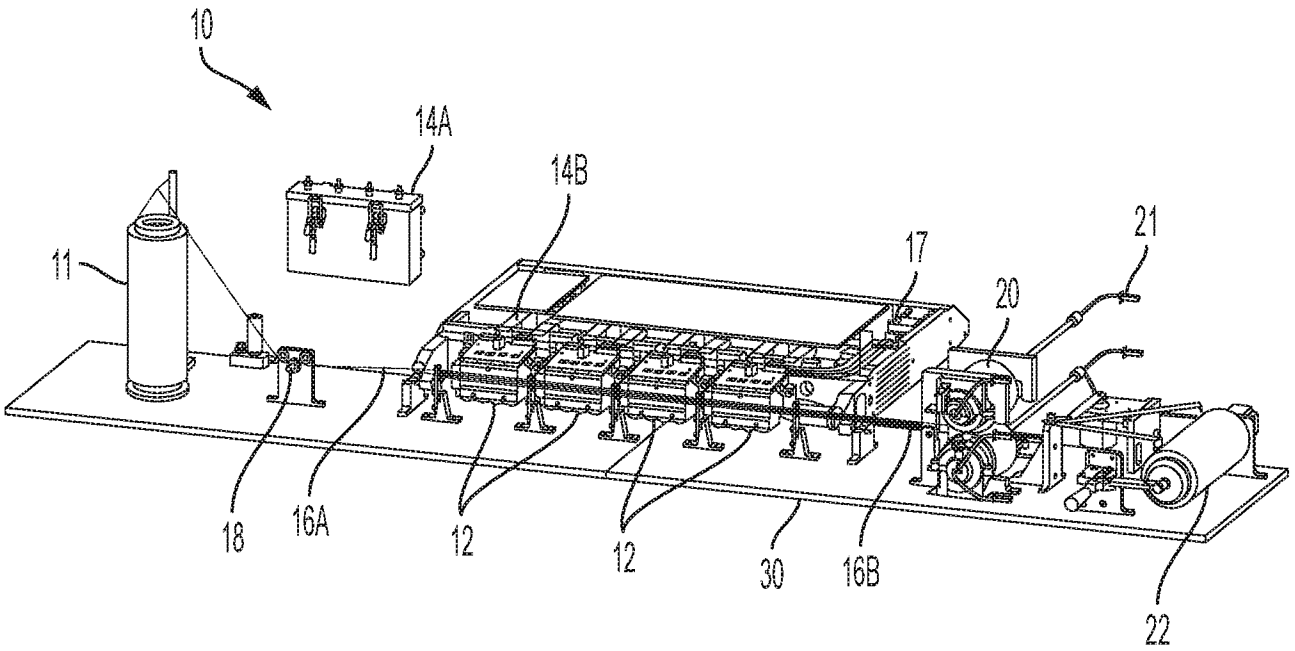
FIG. 1 is a perspective view illustrating various example elements of a printing system for digitally dyeing thread.
Figure 2:
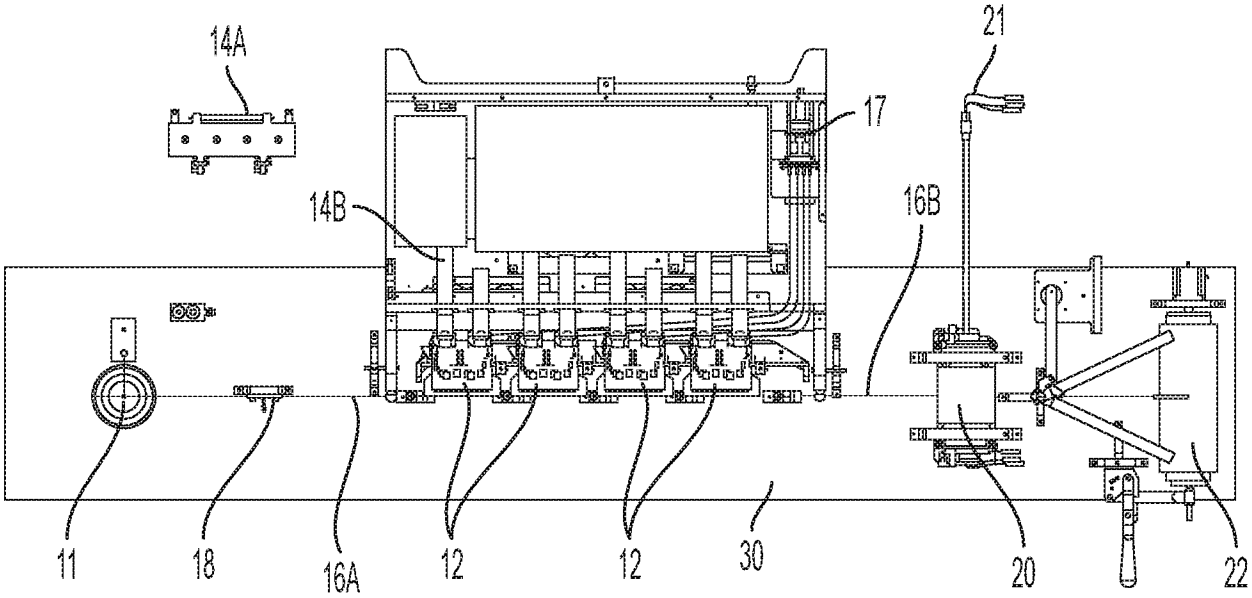
FIG. 2 is a top view of the printing system of FIG. 1.

FIGS. 1 and 2 illustrate example elements of a print system 10 for digitally dyeing thread. FIG. 1 is a perspective view of the print system elements, while FIG. 2 provides a top view of the same elements. As will be described in further detail below, print system 10 is configured to provide direct printing on the thread such that a single thread may incorporate multiple colors along the thread's length. The system includes a set of print heads 12, which as shown may be conventional or customized inkjet print heads of multiple colors. In the embodiment shown, the system includes four print heads 12, each of which is fluidly connected to an ink tank containing ink of a single color. In FIG. 1 an example ink tank 14A is shown separate from the heads for illustration, but in practice a tank will be fluidly connected to each head as shown with ink tank 14B. In a CMYK color arrangement four print heads and four tanks will be provided, so that each print head will eject ink of a single color. For example, in a typical color printing arrangement four print heads will be provided, with one print head for each of cyan, magenta, yellow and black (CMYK) inks, so that the four print heads together may print various combinations of ink resulting in a color gamut of at least 256 colors. However, other numbers of print heads and ink tanks, and other color combinations, are possible and are intended to be included within the scope of this disclosure. Optionally, some ink tanks may contain a thermochromic ink that is capable of changing color when heat is applied.

The print heads 12 are arranged in a row so that a thread 16A and 16B may be pulled under the row, and so that ink from any or all of the heads may be applied to the thread 16A and 16B as the thread passes under each print head 12. The print heads 12 may be elements of a conventional inkjet printer with the other elements shown added on, or they may be part of a print system that is specifically designed with the thread printing elements shown. The print heads may be components of a print engine 17 that is capable of receiving signals from a controller and cause the print heads to operate in response to the controller's signals, such as print engines that are known to those of skill in the art.

As shown in FIGS. 1 and 2, spool 11 is provided as a holder from which source thread will be supplied. The supply of source thread 16A that is to be dyed will be wrapped around the spool 11. The spool 11 may contain source thread of any appropriate color (such as white) that allows for multiple different colors to be visible when applied to the source thread 16A by the print heads 12. While a cylindrical spool 11 is shown, it is understood that the source thread 16A may be stored in other configurations, such as a multi-sided spool (e.g., a spool having five sides, six sides, or more sides), a cone-shaped structure, an hourglass-shaped structure, a spool that includes a rim in which thread is stored (akin to a wheel), or other arrangements.

A guide structure 18 is positioned between the spool 11 and print heads 12 to receive the source thread 16A and position the source thread 16A along a transport path at a level and position that corresponds to the ink ejection locations of each print head 12. The guide structure may be a post with guide wheels as shown, a pathway structure, or another arrangement that is capable of receiving thread from the spool at a variety of angles and position the thread at a single output position.

The source thread 16A will be pulled under the print heads 12 so that the print heads may eject ink toward the source thread. The system may include an unwinder (not shown) positioned after the print heads, or other components of the system may provide the pulling force to move the thread past the print heads 12. In the embodiment of FIG. 1, a fuser 20 will pull the thread as will be described below. Ink from the print heads 12 may absorb into and/or surround the outer periphery of the source thread 16A, transforming the source thread 16A into a dyed thread 16B having printed color(s) visible from all directions. While the print heads 12 are shown to be positioned above the source thread 16A, in alternative configurations the print heads 12 may be positioned relative to the thread path in a location where ink may be ejected toward the thread from another direction, including but not limited to from a side of the thread or below the thread. The ink will soak into the thread and color the thread.

Figure 3:
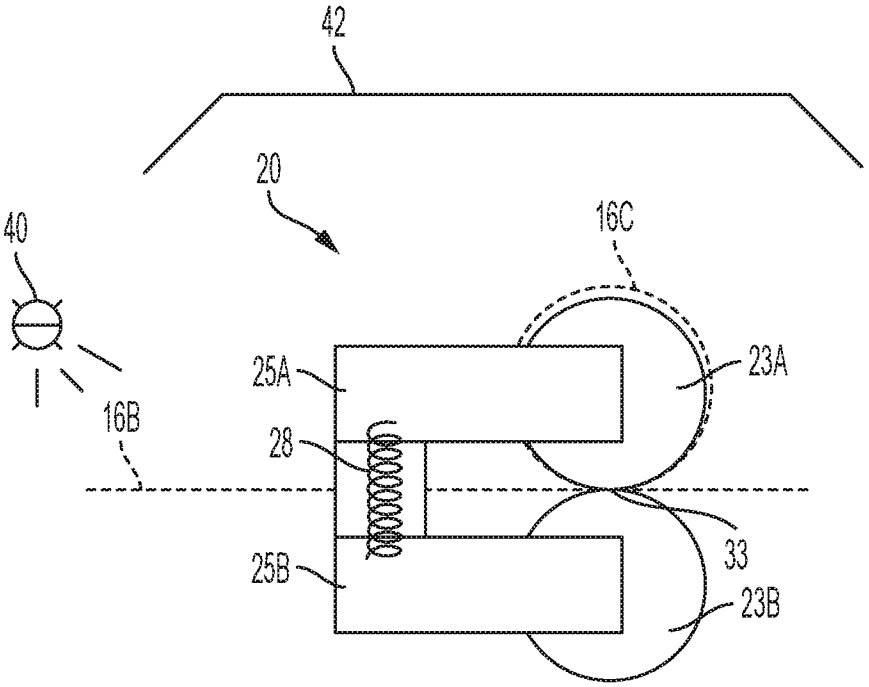
FIG. 3 illustrates components of an example fuser that may be included in the system of FIG. 1.

As the dyed thread 16B exits the print heads 12, it will be drawn into a fuser 20. As shown in FIG. 3, the fuser 20 includes a pair of rollers 23A, 23B, one of which turns clockwise and the other of which turns counterclockwise, positioned so that a contact point 33 between the two rollers 23A, 23B receives the dyed thread 16B after it exits the print heads and pulls the thread through a path at the contact point 33. The two rollers of the fuser may be pressed against each other so that pulling of the thread occurs by application of pressure to the thread at the contact point. This pressure may occur, for example, if each roller is supported by a frame element 25A, 25B, and the frame elements are pulled together by a spring 28 or other structure that pulls the frame elements 25A, 25B (and thus also rollers 23A, 23B) toward each other. The rollers 23A, 23B may comprise an outer layer made of a compressible material such as silicone to allow more force to be applied to the thread. Optionally, after passing the point of contact between the two rollers, the dyed thread 16C may exit the point of contact, be wound around one of the rollers (e.g., 23A), and again pass through the point of contact. This helps provide more pulling force and reduce slipping of the thread between the rollers 23A, 23B.

At least one, and in some cases both, of the rollers may be connected to a drive motor that causes the roller to turn. Returning to FIGS. 1 and 2, at least one, and in some cases both, of the rollers may be connected to or include a heating element 21 that is electrically connected to a power source and serves to heat the roller. The combination of heat and pressure generated by the fuser 20 will fuse the ink onto the dyed thread 16B as the dyed thread passes through the fuser 20. If the thread was coated with thermochromic ink, the fuser also may cause the ink to change color according to the ink's thermochromic properties. Optionally, if the applied ink is an ultraviolet (UV) ink, a UV light source (represented as 40 in FIG. 3) may be positioned at or before the entrance to expose the thread 16B to light and in the ink to the thread 16B before the thread 16B enters the fuser 20. However, a UV light source is optional, as other types of inks that do not require curing by light (such as dye sublimation ink) may be used in some embodiments.

Also optionally, as shown in FIG. 3 a shield 42 may be positioned above or around the fuser and/or UV curing area to hold gases emitted by the ink during the curing and/or fusing process. The shield 42 helps to retain the emitted gases in the curing or fusing area around the thread until the curing/fusing is complete, thus promoting a more complete application of ink to the thread.

After the dyed thread exits the fuser 20, the dyed thread may be delivered via a shuttle or other device to an intake of an embroidery machine to be incorporated into fabric that the machine produces. Alternatively, as shown in FIGS. 1 and 2, the dyed thread may be received by a take-up spool 22, which is driven and turned by a motor to draw the dyed thread around a bobbin for storage.

Some or all of the components of the print system 10 may be supported by a substrate 30. Some or all of the substrate 30 also may serve to catch any overspray or ink that is ejected by the ink heads that passes beyond or falls from the thread.

Figure 4:
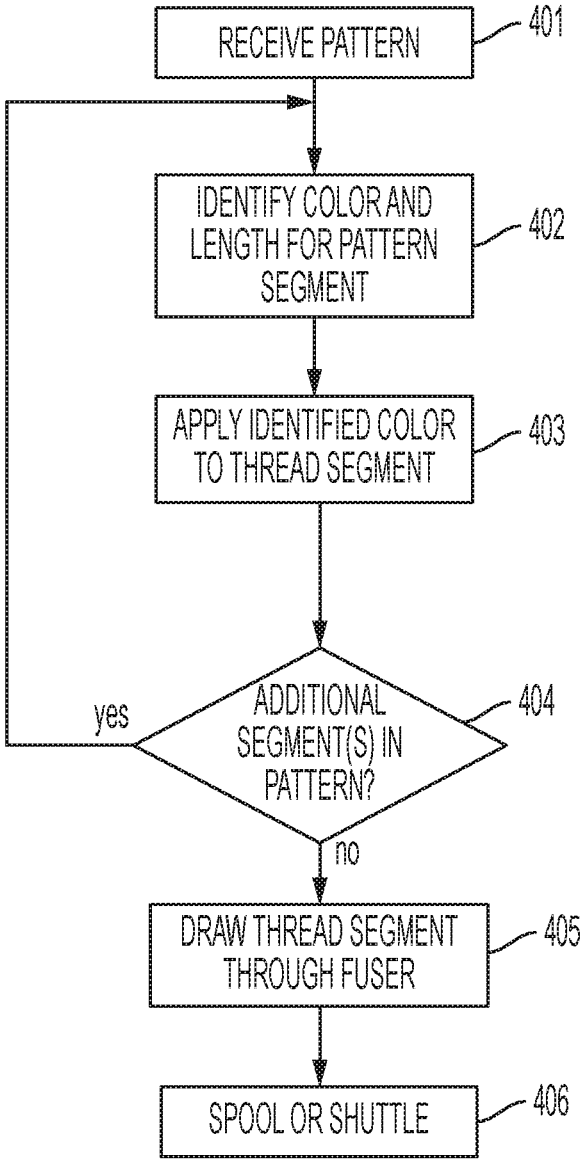
FIG. 4 is a flow diagram of a process of dyeing thread.

FIG. 4 illustrates a method by which a print system such as that described above may digitally dye thread. Various elements of the print system, such as the print heads, the motors that drive the fuser and/or take-up spool, and the heating elements may be controlled by a controller. The controller includes one or more electronic devices having a processor and a communication device that transmits signals to the print system components and thus cause the system components to take actions according to the signals. Components of such electronic devices will be discussed below in the context of FIG. 5. As explained in FIG. 4, the system's processor will receive or access a digital file or instruction containing a pattern (step 401). The pattern will be a set of parameters that the print system will use to apply color(s) to the thread. The pattern may identify one or more consecutive segments of the thread, each of which will be defined by a length. The system may determine length for each thread segment based on actual measured length, by rotation of one or more components (such as rotations of a fuser roll), or by another means. The pattern also will identify a color to be applied to each segment. The print system will identify a segment and that segment's color from the pattern (step 402), and it will then cause a component of the print system to pull the thread from the source spool, past the print heads, and toward the fuser. The print system will instruct the print heads to apply a combination of one or more inks that will result the identified color to the segment (step 403), and then continue to draw the thread segment through the fuser (step 405) to fuse the ink to the thread. The system may vary the fuser temperature, dwell time, speed of movement of the thread, or other parameters based on rules or parameters defined in the pattern file. For example, the system may determine or select any such parameters based on the type of thread, stretch characteristics, amount of ink, type of ink, required based on thread material etc. will be predetermined. This information may cause the system's controller to adjust the speed of the thread, print time duration and fuser station temperature and exposure levels. The patterned image may be determined based on the thread stitching density (#threads per inch) of the weaving equipment.

Once the end of a particular thread segment is about to pass through the print heads, the system will determine whether a next segment is in the pattern (step 404). If so, the system will stop applying ink of the first color to that segment and then repeat the process of identifying ink for the additional segment, applying the ink to the additional segment, and fusing the ink to the additional segment. This process will continue until ink has been applied to all segments of the pattern. In this way, the print system may produce a strand of multicolored thread having two or more segments of different colors.

Once the process is completed, the print system will either roll the dyed thread onto a take-up spool or pass the thread to a shuttle of a fabric weaving system (step 406).

Figure 5:
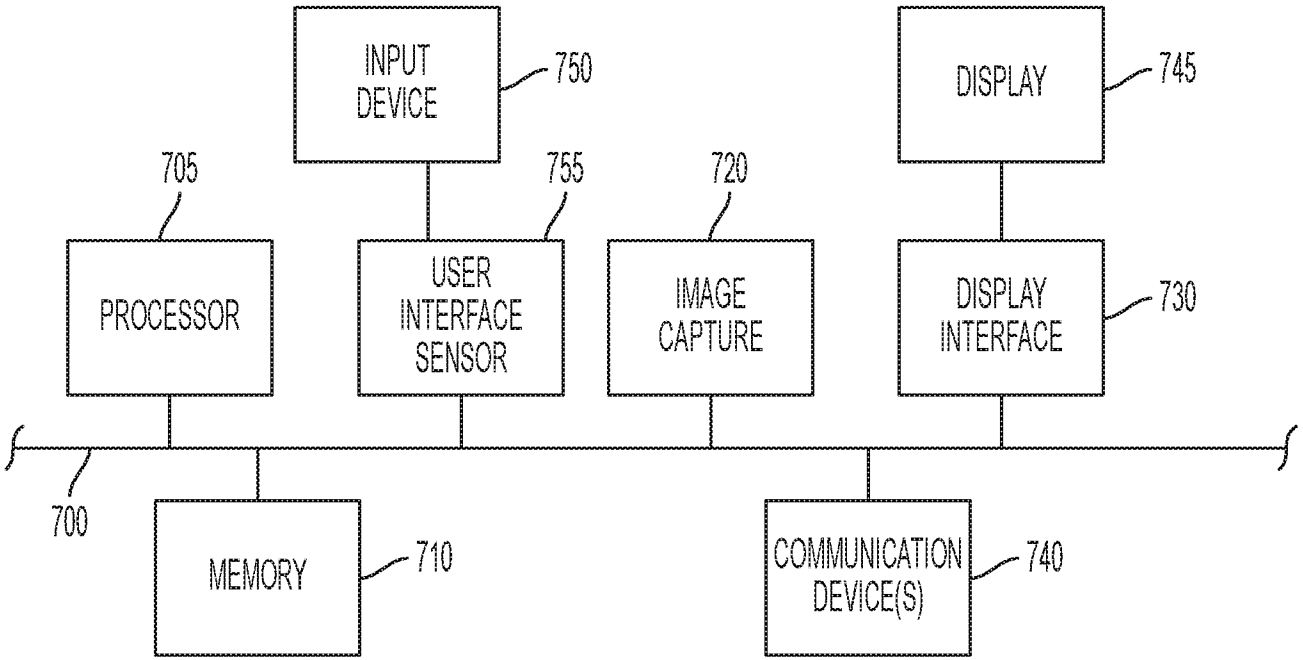
FIG. 5 depicts various embodiments of one or more electronic devices for controlling the various methods and systems described in this document.

FIG. 5 depicts an example of internal hardware that may be included in any of the electronic components of the system, such as system's controller. An electrical bus 700 serves as an information highway interconnecting the other illustrated components of the hardware. Processor 705 is a central processing device of the system, configured to perform calculations and logic operations required to execute programming instructions. As used in this document and in the claims, the terms "processor" and "processing device" may refer to a single processor or any number of processors in a set of processors that collectively perform a set of operations, such as a central processing unit (CPU), a graphics processing unit (GPU), a remote server, or a combination of these. Read only memory (ROM), random access memory (RAM), flash memory, hard drives and other devices capable of storing electronic data constitute examples of memory devices 710. A memory device may include a single device or a collection of devices across which data and/or instructions are stored.

An optional display interface 730 may permit information from the bus 700 to be displayed on a display device 745 in visual, graphic or alphanumeric format. An audio interface and audio output (such as a speaker) also may be provided. Communication with external devices may occur using various communication devices 740 such as a wireless antenna, an RFID tag and/or short-range or near-field communication transceiver, each of which may optionally communicatively connect with other components of the device via one or more communication system. The communication device 740 may be configured to be communicatively connected to a communications network, such as the Internet, a local area network or a cellular telephone data network.

The hardware may also include a user interface sensor 755 that allows for receipt of data from input devices 750 such as a keyboard, a mouse, a joystick, a touchscreen, a touch pad, a remote control, a pointing device, a video input device and/or an audio input device. Data also may be received from an image capturing device 720, such of that a scanner or camera.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to."

In this document, when terms such as "first" and "second" are used to modify a noun, such use is simply intended to distinguish one item from another, and is not intended to require a sequential order unless specifically stated.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

The term "thread" as used in this document refers to fibrous threads such single-strand or multi-strand threads, strings, yarns, and/or monofilaments.

The terms "controller", "computer", and "computing device" refer to a device or system that includes a processor and memory. Each device may have its own processor and/or memory, or the processor and/or memory may be shared with other devices as in a virtual machine or container arrangement. The memory will contain or receive programming instructions that, when executed by the processor, cause the electronic device to perform one or more operations according to the programming instructions. Examples of computing devices include personal computers, servers, mainframes, virtual machines, containers, mobile electronic devices such as smartphones, Internet-connected wearables, tablet computers, laptop computers, and appliances and other devices that can communicate in an Internetof-things arrangement. In a client-server arrangement, the client device and the server are electronic devices, in which the server contains instructions and/or data that the client device accesses via one or more communications links in one or more communications networks. In a virtual machine arrangement, a server may be an electronic device, and each virtual machine or container also may be considered an electronic device. In the discussion above, a client device, server device, virtual machine or container may be referred to simply as a "device" for brevity. Additional elements that may be included in electronic devices are be discussed above in the context of FIG. 5.

The terms "processor" and "processing device" refer to a hardware component of an electronic device that is configured to execute programming instructions. Except where specifically stated otherwise, the singular terms "processor" and "processing device" are intended to include both single-processing device embodiments and embodiments in which multiple processing devices together or collectively perform a process.

The terms "memory," "memory device," "data store," "data storage facility" and the like each refer to a non-transitory device on which computer-readable data, programming instructions or both are stored. Except where specifically stated otherwise, the terms "memory," "memory device," "data store," "data storage facility" and the like are intended to include single device embodiments, embodiments in which multiple memory devices together or collectively store a set of data or instructions, as well as individual sectors within such devices.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A thread printing system, comprising:

a source spool for holding a thread;

a plurality of print heads, each of which is fluidly connected to an ink tank for holding ink, wherein the print heads are positioned to direct and apply ink to a segment of the thread as the thread travels along a transport path along from the source spool; and a fuser comprising:

a first roller that is connected to a heating element, wherein the fuser is positioned to receive the thread after the print heads apply ink to the thread so that heat will fuse the ink to the thread, and a second roller that is positioned to contact the first roller at a contact point;

wherein the fuser is positioned to pass the thread through the contact point, and the fuser is configured to pull the thread along the transport path past the print heads.

2. The thread printing system of claim 1, further comprising a drive motor that is configured to cause the first roller, the second roller, or both to rotate.

3. The thread printing system of claim 1, further comprising:

a controller;

and a memory containing programming instructions that are configured to cause the controller to:

receive a pattern comprising a first segment length and a first color, cause the print heads to apply ink of the first color to a first segment of the thread as the thread travels along the transport path past the print heads, wherein the first segment of the thread has a length that corresponds to the first segment length, and stop the print heads from applying the ink of the first color to the thread when the first segment length has passed the print heads.

4. The thread printing system of claim 3, further comprising additional programming instructions that are configured to cause the controller to:

use the pattern to identify a second segment length and a second color, cause the print heads to apply ink of the second color to a second segment of the thread as the thread travels along the transport path past the print heads, wherein the second segment of the thread is adjacent to the first segment of the thread and has a length that corresponds to the second segment length, and stop the print heads from applying the ink of second color to the thread when the second segment length has passed the print heads.

5. The thread printing system of claim 1, further comprising a guide structure that is positioned and configured to receive the thread from the source spool at any of a plurality of angles and direct the thread to the transport path.

6. The thread printing system of claim 1, further comprising a take-up spool that is positioned and configured to receive the thread from the fuser and wrap the thread around a bobbin.

7. The thread printing system of claim 1, wherein the fuser further comprises:

a first frame element that is attached to the first roller;

a second frame element that is attached to the second roller; and a spring that is connected to the first frame element and the second frame element to draw the frame elements and rollers toward each other.

8. The thread printing system of claim 1, wherein the ink is an ultraviolet (UV) ink, and the system further comprises a UV light source positioned between the print heads and the fuser and operable to direct UV light toward the thread before the thread enters the fuser.

9. The thread printing system of claim 1, further comprising a shield positioned over at least a portion of the fuser and configured to retain gas emitted by the ink in an area of the fuser during operation.

10. The thread printing system of claim 1, wherein the first roller and the second roller are configured such that, during operation, the thread will, after passing through the contact point, be wound around one of the rollers and again pass through the point of contact.

11. A method of applying ink to thread, the method comprising:

by a thread printing system that comprises a source spool, a plurality of print heads, a controller, and a fuser comprising a pair of rollers that touch at a contact point and that are connected to a heating element:

receiving a pattern comprising a first segment length and a first color;

passing thread from the source spool along a transport path that corresponds to ink ejection locations of the print heads by applying a force from the pair of rollers to the thread at the contact point as the thread passes through the contact point;

by the print heads, applying ink of the first color to a first segment of the thread as the thread travels along the transport path past the print heads;

transporting the thread with applied ink to the fuser; and by the fuser, applying heat to the thread to fuse the applied ink to the thread.

12. The method of claim 11, further comprising:

by the controller, using the pattern to identify a second segment length and a second color; and by the print heads, applying ink of the second color to a second segment of the thread as the thread travels along the transport path past the print heads.

13. The method of claim 11, wherein:

the system further comprises a take-up spool; and the method further comprises, by the take-up spool, receiving the thread from the fuser and wrapping the thread around a bobbin.

14. The method of applying ink to thread of claim 11, wherein after the thread exits the point of contact, the thread is wound around one of the rollers and again passes through the point of contact.

15. A thread printing system, comprising:

a source spool for holding a thread;

a plurality of print heads, each of which is positioned to direct and apply ink to the thread as the thread travels along a transport path along from the source spool; and a fuser comprising:

a first roller that is connected to a first heating element, and a second roller that is positioned to contact the second roller at a contact point, wherein the fuser is positioned to receive the thread at the contact point after the print heads apply ink to the thread so that the heat will fuse the ink to the thread, and wherein the fuser is configured to pull the thread along the transport path from the source spool through the contact point.

16. The thread printing system of claim 15, further comprising a drive motor that is configured to cause the first roller, the second roller, or both to rotate.

17. The thread printing system of claim 15, further comprising:

a controller;

and a memory containing programming instructions that are configured to cause the controller to:

receive a pattern comprising a first segment length, a first color, a second segment length and a second color, cause the print heads to apply ink of the first color to a first segment of the thread as the first segment travels along the transport path past the print heads, stop the print heads from applying the ink of the first color when the first segment length has passed the print heads, cause the print heads to apply ink of the second color to a second segment of the thread as the second segment travels along the transport path past the print heads, and stop the print heads from applying the ink of second color when the second segment length has passed the print heads.

18. The thread printing system of claim 15, further comprising a take-up spool that is positioned and configured to receive the thread from the fuser and wrap the thread around a bobbin.

19. The thread printing system of claim 15, wherein the fuser further comprises:

a first frame element that is attached to the first roller;

a second frame element that is attached to the second roller; and a spring that is connected to the first frame element and the second frame element to draw the frame elements and rollers toward each other.

20. The thread printing system of claim 15, wherein the first roller and the second roller are configured such that, during operation, the thread will, after passing through the contact point, be wound around one of the rollers and again pass through the point of contact.

* * * * *